US005722576A

United States Patent [19]

Rogers

[11] Patent Number: 5,722,576

[45] Date of Patent: Mar. 3, 1998

[54] TRACK MEMBER SYSTEM

[75] Inventor: William H. Rogers, Jacksonville, Fla.

[73] Assignee: Safariland Ltd., Inc., Ontario, Calif.

[21] Appl. No.: 637,504

[22] Filed: Apr. 25, 1996

[51] Int. Cl.[6] ..... A45F 5/00

[52] U.S. Cl. ..... 224/195; 224/660; 224/666; 224/271; 224/911

[58] Field of Search ..... 224/581, 582, 224/583, 194, 195, 604, 605, 647, 648, 649, 631, 632, 240, 660, 663, 666, 667, 668, 671, 271, 682, 911, 901.4, 901.6; 2/102, 311, 312, 319

[56] References Cited

U.S. PATENT DOCUMENTS

| | | | |
|---|---|---|---|
| 111,450 | 1/1871 | Hayden | 224/915 |
| 162,055 | 4/1875 | Goss | 224/195 |
| 197,946 | 12/1877 | Rogers | 224/195 |
| 208,263 | 9/1878 | Platz et al. | 224/195 |
| 775,149 | 11/1904 | Righton | 224/195 |
| 833,911 | 10/1906 | Bate | 224/195 |
| 3,374,636 | 3/1968 | Mason | 2/312 |
| 3,664,560 | 5/1972 | Perkins | 224/911 |
| 4,128,194 | 12/1978 | Hinz | 224/194 |
| 4,819,846 | 4/1989 | Hannemann | 224/901.6 |
| 5,419,473 | 5/1995 | Lamar | 224/632 |
| 5,464,136 | 11/1995 | Eddy | 224/901.4 |

FOREIGN PATENT DOCUMENTS

| | | | |
|---|---|---|---|
| 3844675 | 6/1990 | Germany | 224/211 |

*Primary Examiner*—Henry J. Recla
*Assistant Examiner*—Gregory M. Vidovich
*Attorney, Agent, or Firm*—Arthur G. Yeager

[57] ABSTRACT

A system for carrying containers suspended from a track member which may be attached to a body encircling belt or attached to clothing which includes a pair of protruding tracks substantially parallel and from which the containers for holding articles are suspended by clips on the containers which are positionable lengthwise on the tracks and may slide thereon and enter and exit the track at tapered ends of the tracks and is particularly useful for police and military personnel in carrying weapons, ammunition and the like holstered articles.

19 Claims, 2 Drawing Sheets

TRACK MEMBER SYSTEM

TECHNICAL FIELD

This invention relates to harness systems to be worn by humans for purposes of carrying items of equipment, most particularly, it relates to belts with protruding tracks to which containers can be attached for carrying articles of various types.

BACKGROUND OF THE INVENTION

Police and military personnel have for a long time carried weapons and ammunition attached to a waist encircling belt. In recent years the need for added security has caused a proliferation of safety holsters to protect the wearer from losing his weapon to an attacker. The many designs of safety holsters all require a rigid belt which provides structural integrity and a stable platform from which to draw. The standard has become a 2.25 inch wide belt that is 0.25 inch thick. These belts are made from a variety of materials, but even the lightest belts, combined with the attaching belt loops that go on each container carried, add up to several pounds. A lighter belt system has been needed that would also eliminate the bulky belt loops necessary for each container, i.e., magazine case, holster, handcuff case, radio case, etc.

It is an object of this invention to provide a novel, lightweight system for carrying containers by a wearer. Such system must be as strong or stronger than that which is presently used, and can be adapted to be worn around the waist, chest or thigh of the wearer. It is another object of this invention to provide a novel track system to which the many various containers easily attach. Such a track system, which can be incorporated into an armored vest or an extremely lightweight belt, does not require a heavy material separating the tracks, nor do the containers used therewith become apparent from the more detailed description which follows.

BRIEF SUMMARY OF THE INVENTION

This invention relates to a planar member for carrying a container including a belt having an outside surface facing away from an encircled body and an inside surface facing that body and a track means protruding outwardly from that outside surface and extending lengthwise of the belt. The container is detachably connected to the track means and slidable along that track means by way of a tubular guide having an internal hollow adapted to slide along the track means while being frictionally clamped thereto.

In preferred embodiments of the invention there are two spaced parallel tracks which are engaged by a clip having two guides attached to the article container. In another preferred embodiment the tracks are fabric covered tubes sewn to opposite edge portions of a central fabric web to form the tracked belt of this invention, and the guides are two spaced, C-shaped, rigid, smooth surfaced grooves adapted to fit over and slide along the tracks. It is these guides that are firmly fastened to article containers so as to provide the carrying function of this system. The belt is preferably prepared with fabric hooks on the inside of the belt and fabric hooks and loops on overlapping ends to provide for a closure which therefore need not rely on a buckle.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in consideration with the accompanying drawings in which:

DETAILED DESCRIPTION OF THE INVENTION

Figure 1:
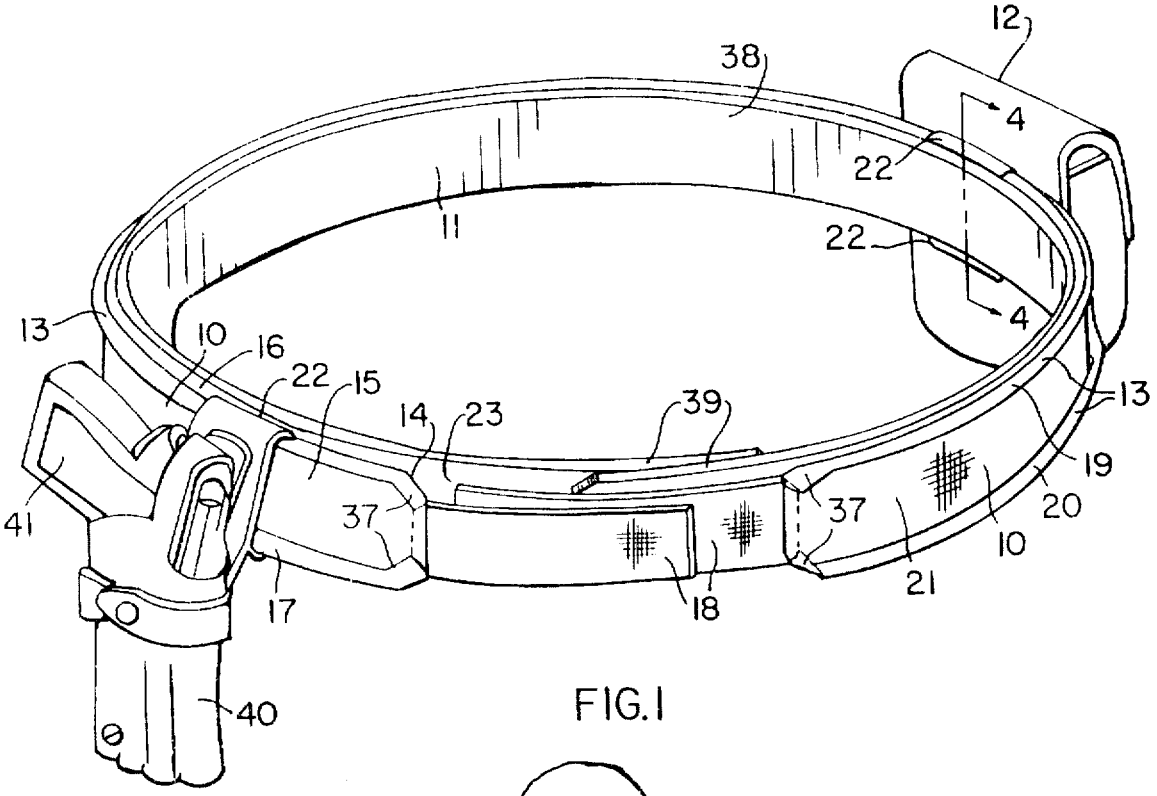
FIG. 1 is a perspective view of the track belt system of this invention as it might appear around the waist of a wearer.
Figure 4:
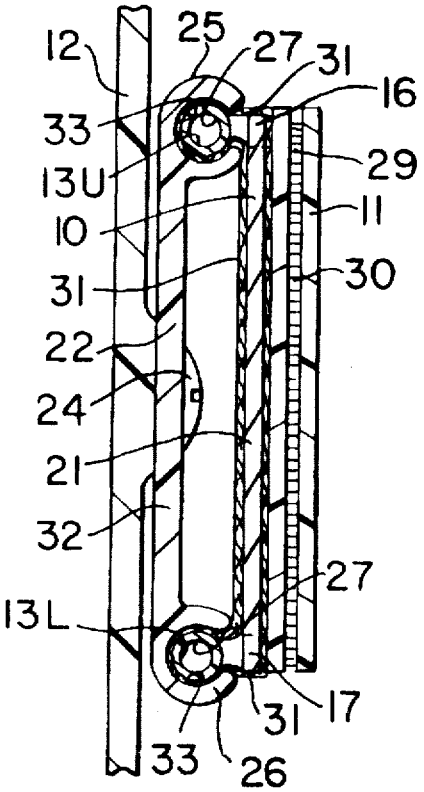
FIG. 4 is a cross-sectional view taken at 4—4 of FIG. 1.
Figure 2:
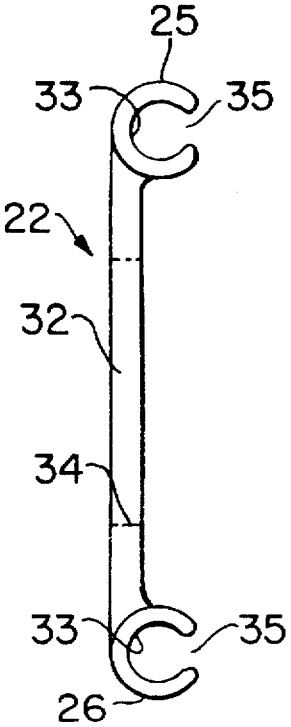
FIG. 2 is an end elevation of a guide used in this invention to attach an article-carrying container to the track belt.
Figure 3:
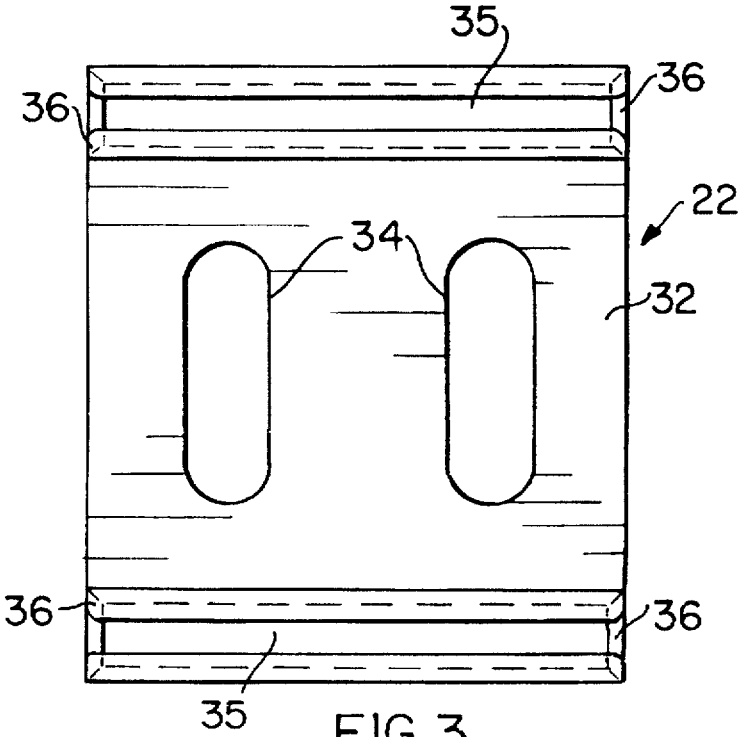
FIG. 3 is a front plan view of the guide shown in FIG. 2.

This invention relates to a belt system as shown in FIG. 1; the details of which are shown in FIGS. 2–4. Attention is called to these drawings and to the reference numbers thereon to obtain the best understanding of all features of this invention.

In FIG. 1 there is a view of how the belt components would appear when positioned around the waist of a wearer and as viewed by an observer facing the front of the wearer. The body of the wearer is omitted for the sake of full clarity.

In many instances the belt system of this invention is most securely worn when an internal belt 11 is included, although the belt system of this invention does not necessarily include internal belt 11. Belt 11 is worn outside the clothing, i.e., outside the trousers, skirt, or jacket of the wearer. Belt 11 has an inside surface 38 and an outside surface 23. Inside surface 38 may be of any texture or type, rough, smooth, leather, fabric, or the like. Outside surface 23 is covered with a layer of fabric loops of the type useful in Velcro fasteners. In order for inside belt 11 to be the most comfortable and useful, the closure of the belt is accomplished by overlapping ends 39 fitted with cooperating surfaces of fabric loops and fabric hooks so as to eliminate the bulkiness of a buckle. This is not necessary, but is a preferred arrangement. The main purpose for inside belt 11 is to provide a secure surface of fabric loops for attachment of track belt 10 which is the next component of this invention to be added. Track belt 10 is the principal support component of this system. It encircles around belt 11, if one is worn, and has a central body 21 of an elongated narrow web fabric having an upper edge 16 and a lower edge 17, an outside surface 15 and an inside surface 14. Along edge portions 16 and 17, there are track means in the form of a pair of tracks 13 which are protruding shoulders or guides 19 and 20 extending outwardly from the outside surface 15 of the belt body 21. Overlapping ends 18, like ends 39 of belt 11, are fitted with cooperating portions of fabric loops and fabric hooks in order to provide a secure closure for belt 10. Tracks or guides 13 extend generally the length of belt 10 from one overlapping end 18 to the other overlapping end 18. Tracks 13 are flexible tubular members, preferably covered by a layer of fabric, canvas, nylon or the like, and sewn to central body 21 to produce a single component. The fabric covering track or guides 13 is generally folded neatly to make tapered ends 37 that will provide a smooth transition from the protruding shoulders of 19 and 20 to the smooth flat surface of body 21.

It is, of course, not critical that belt 10 be made of web fabric at 21, and covered by fabric around tracks 13. Other materials are useful for these purposes, e.g., leather, molded plastic, etc. Buckles may be employed instead of Velcro fabric fasteners for closures of belts 10 and 11, but the preferred is as described above for fabric components, canvas, nylon and the like. As will be seen, tracks 13 may be of any shape (e.g., T-shape, triangular, etc.) so long as they protrude from the belt 10 and can be attached to containers.

It is to the above basic structure of the track belt 10 that containers or articles may be attached for carrying. These might include a holster 40 for a pistol 41, or a carrier 12 for handcuffs or a first-aid kit, or the like. Holster 40 or carrier 12 are attached to belt 10 by means of clips 22 as generally seen in FIG. 1.

In FIGS. 2 and 3 there is shown a clip 22 which is preferred for engagement with tracks 13 so as to suspend an article-carrying container therefrom. Clip 22 has two parallel, spaced guideways 25 and 26 which are rigidly joined to each other by a body plate 32. Preferably these components are all part of a molded plastic article having a smooth surface and is substantially rigid and inflexible. Guideways 25 and 26 are hollow tubes with a lengthwise slot 35 such that the cross-sectional shape of guideway 25 or 26 is in the form of the letter C. The open slot 35 is oriented to extend lengthwise of each guideway 25 and 26 and to face away from body plate 32. Guide slots 35 are spaced substantially the same as the spacing between tracks 13 or guides 19 and 20 such that the protruding portion of guides 19 and 20 will slide into the hollows 33 in guideways 25 and 26 and fit snugly therein, permitting clip 22 to slide along belt 10 while connected to shoulders 19 and 20. Body plate 32 preferably has two spaced slots 34 therein for fasteners, e.g., T-nuts, to firmly attach an article container to clip 22 in an appropriate vertical position. The article container might be a gun holster, an ammunition clip or reloader holster, handcuff holder, canteen cover and the like. Preferably two T-nuts or other fasteners are used in slots 34 so as to hold the article container in a fixed selected position, since only one such T-nut might permit the container to rotate out of the desired position. The ends of guide slots 35 are preferably tapered, as at 36, to facilitate the attachment of guide clip 22 to guides 19 and 20 of belt 10.

In FIG. 4 there is shown a cross sectional view of the track belt system of this invention at a location of an article-carrying container. This is a cross-section taken along line 4—4 of FIG. 1. Inner belt 11 is attached to track belt 10 through the engagement of fabric hooks 29 on track belt 10 to fabric loops 30 on inner belt 11. Track belt 10 has a web fabric body connected at its upper edge portion 16 to upper track 13U and at its lower edge portion 17 to lower track member 13L. Tracks 13U and 13L are each lengths of tubing 27, fiber, nylon, plastic, etc., covered with a layer of fabric 31. When central web body 21 is sewn to fabric cover 31 and tubular members 27, the result is a firm, but flexible, tough belt.

Container 12 has a guide clip 22 attached thereto by means of two T-nuts 24 passing through slots 34 (as seen in FIG. 3). Hollows 33 of guide clip 22 extends more than halfway around the protruding guides formed by tracks 13U and 13L so as to make it difficult, if not impossible, for the tracks 13U and 13L to permit slots 35 from being pulled away from the tracks 13, but make it easy for the hollows 33 to slide lengthwise over the tracks 13U and 13L. The slots 35 closely engage the tracks 13 so that the positions of the container 12 remain in position until forcibly changed. Also, since clip 22 is planar and hollows 33 are straight and parallel, there is an enhanced frictional engagement when the belt is worn about the waist since the belt and the tracks 13 are in an arcuate position tending to force the guides 19 and 20 at the end engagement with the guide slots 35 through same and thus the guides 19 and 20 are squeezed somewhat but do not become disengaged therefrom.

Figure 5:
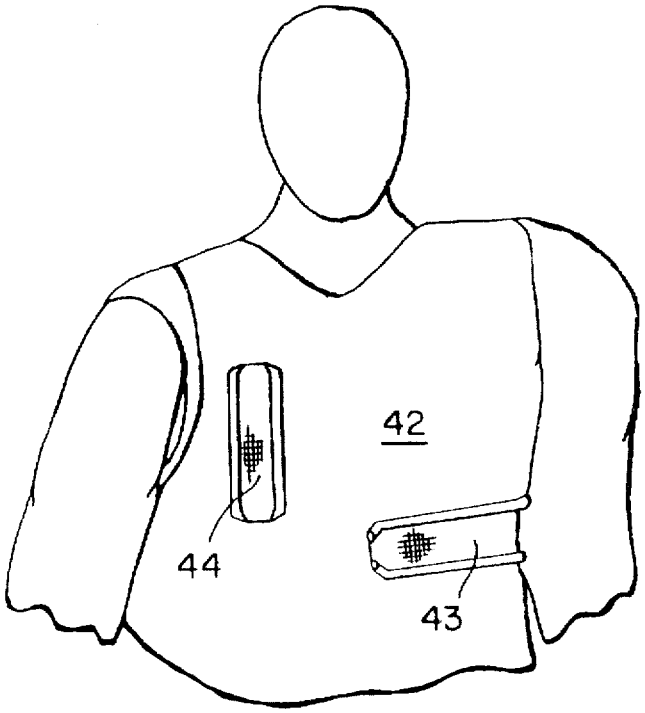
FIG. 5 is a perspective view of an armored vest, or the like, upon which are two track belt portions, showing two positions for attaching such portions to the vest.

FIG. 5 is an illustration of a protective flak jacket (sometimes referred to as an armored vest) with portions of track belts of this invention attached thereto for purposes of carrying containers of items as has been discussed above. Jacket 42 usually covers the upper body of a person, usually leaving the arms unprotected. Such a jacket generally is made of layers of material which together are able to absorb the forces of a bullet and prevent it from penetrating to the body of the wearer. To such a flak jacket 42 lengths of the tracked belt of this invention may be attached horizontally as at 43, vertically as at 44, or in any other desired orientation. The tracked belts 43 and 44 of this invention may, of course, be used to attach any convenient or desired object which has a guide clip 22 attached thereto. This is merely an illustration of a portion of this invention which is intended to cover the use of a guide clip like that of 22 as an attachment means to a tracked belt 10 or portion thereof (as 43 or 44) to carry items of any sort.

Among the advantages of this track belt system over prior art systems is that this system is comfortable and will stand much wear and tear; it is flexible and lightweight; the tracks 13 are hollow tubes having great strength and toughness; the belt can be made with some play in the spacing between tracks and thus permitting errors in alignment to be usable; and tapered ends 36 on the hollows 33 of clips 22 can be increased or decreased to make insertion of shoulders 19 and 20 into hollows 33 easier or more difficult as the situation requires; and, finally, buckles may be added to belts 10 or 11 to dress up the system as desired.

It should be noted that while a two-track belt system is shown in the drawings, and described above, operable systems for some applications may be derived from one, or several tracks, although two tracks are preferred. For example, the belt system may be configured to be worn about a thigh portion of a wearer's body.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A tracked member for a human to wear for carrying a container, said tracked member comprising an elongated planar member having an outside surface facing away from a wearer's body and an inside surface facing toward the body, an elongated track means protruding outwardly from said outside surface and extending lengthwise of said member, said track means including a pair of spaced parallel track members, said tracked member further including an elongated tubular guide means having a pair of spaced internal hollows complemental to respective said track members and selectively positionable lengthwise along said track members while being frictionally clamped thereto, said guide means adapted to be firmly attached to a container to position same along said track members.

2. The tracked member of claim 1 wherein said track members extend generally horizontally around a waist of a wearer.

3. The tracked member of claim 1 wherein said track members each has a substantially circular cross-section.

4. The tracked member of claim 1 wherein said planar member includes a belt having an elongated narrow strip of fabric having two spaced elongated edges, said track members being defined by a pair of spaced parallel elongated tubular members positioned respectively along said elongated edges of said strip of fabric, said tubular members and said narrow strip all being covered by a smooth tough layer of fabric sewn into and forming a single unitary belt.

5. The tracked member of claim 4 wherein each said tubular member is shorter in length than said belt, and wherein a tapered connection is formed by said narrow strip to join an end of said tubular member with said outside surface of said belt.

6. The tracked member of claim 1 wherein said tubular guide means includes a pair of rigid elongated guide rails having a cross-section in the shape of the letter C, each said rail having a lateral passageway smaller than respective said track member to inhibit passage laterally therefrom, each said guide rail having a lengthwise entrance to receive respective said track member slidingly therethrough.

7. The tracked member of claim 1 wherein said planar member has opposite end portions, said tracked member further including a closure means of cooperating fabric hooks and fabric loops on respective said end portions of said planar member.

8. The tracked member of claim 1 wherein said planar member is adapted to attached to an armored vest as protective clothing for a wearer.

9. The tracked member of claim 1 further comprising a container formed into a handgun holster.

10. The tracked member of claim 1 wherein said planar member is a belt adapted to encircle the waist of a wearer's body, with said track members exposed outwardly therefrom.

11. The tracked member of claim 10 further comprising an inner planar belt having an outside surface adjacent said inside surface of said planar member, said inner belt having fabric loops substantially along said outside surface, said planar member having a layer of fabric hooks on said inside surface, said tracked member being detachably connected to said inner belt by said fabric loops and fabric hooks.

12. A tracked belt for carrying a container detachably secured thereto, said tracked belt comprising an elongated narrow belt adapted to encircle a body part and including an upper and a lower edge portion, an inside surface facing said body part, an outside surface facing away from the body part and two ends adapted to be releasably attached to each other, said upper and lower edge portions each carrying an elongated tubular member extending generally the length of said belt forming an upper shoulder guide and a lower shoulder guide substantially parallel with each other and protruding outwardly from said outside surface, said tubular members being separated by and attached to a central flat semiflexible body, a smooth inflexible first clip having a guideway for each said shoulder guide of said belt, said guideway having a cross-section with an internal area substantially the same in size and shape to said shoulder guide and having a lengthwise slit to permit respective said guideway to be positioned onto respective said shoulder guides, said clip being adapted to be firmly attached to a container.

13. The tracked belt of claim 12 further comprising an inner belt worn between the body part and said inside surface, said inner belt including an outside surface having fabric loops thereon, said narrow belt having fabric hooks on said inside surface for detachably connecting said fabric hooks to said fabric loops.

14. The tracked belt of claim 12 further comprising a container formed into a handgun holster.

15. The tracked belt of claim 12 further comprising at least two spaced fasteners adapted to attach said clip to a container.

16. The tracked belt of claim 15 wherein said guideways have smooth and tapered entrance ends.

17. The tracked belt of claim 12 wherein each said tubular member is a hollow cylindrical tube.

18. The tracked belt of claim 12 wherein each said slit extends substantially horizontal and parallel to each other.

19. The tracked belt of claim 12 further comprising a container and another container having another inflexible clip mounted thereon and being substantially identical to said first clip, said container being formed as a handgun holster and being spaced from said another container for carrying another article.

* * * * *